US005953027A

United States Patent [19]

Suwabe et al.

[11] Patent Number: 5,953,027

[45] Date of Patent: Sep. 14, 1999

[54] METHOD AND APPARATUS FOR REDIRECTING PROPAGATING ACOUSTIC WAVES FROM A SUBSTRATE TO A SLANT FACE TO CAUSE INK-JETTING OF INK MATERIAL

[75] Inventors: Yasufumi Suwabe; Yoshiyuki Shiratsuki; Ichiro Asai; Koichi Haga; Keizo Abe, all of Nakai-machi, Japan

[73] Assignee: Fuji Xerox Co., Ltd., Tokyo, Japan

[21] Appl. No.: 08/731,780

[22] Filed: Oct. 18, 1996

[30] Foreign Application Priority Data

Dec. 28, 1995 [JP] Japan ..... 7-343739

[51] Int. Cl.[6] ..... B41J 2/135

[52] U.S. Cl. ..... 347/46

[58] Field of Search ..... 347/46, 40, 68

[56] References Cited

U.S. PATENT DOCUMENTS

| | | | |
|---|---|---|---|
| 4,697,195 | 9/1987 | Quate et al. | 347/46 |
| 4,719,480 | 1/1988 | Elrod et al. | 347/46 |
| 5,063,396 | 11/1991 | Shiokawa et al. | 347/46 |
| 5,179,394 | 1/1993 | Hoshino et al. | 347/46 |
| 5,354,419 | 10/1994 | Hadimioglu | 347/46 X |
| 5,392,064 | 2/1995 | Hadimioglu et al. | 347/46 |

FOREIGN PATENT DOCUMENTS

| | | |
|---|---|---|
| A 54-10731 | 1/1979 | Japan . |
| A 62-66943 | 3/1987 | Japan . |
| A 2-269058 | 11/1990 | Japan . |
| A 4-14455 | 1/1992 | Japan . |

OTHER PUBLICATIONS

IEEE Transaction on Ultrasonics, Ferroelectrics and Frequency Control, vol. 36, No. 2, 1989, pp. 178–184.

Study on SAW Streaming and its Application to Fluid Devices, Shiokawa et al., Faculty of Engineering, Shizuoka University, US89–51, pp. 41–46.

I.A. Viktorov, "Transmission and Reflection Property of Raley Surface Acoustic Wave on Various Curved Surfaces Having Unique Curvatures," Acoustic Research Lab. of Soviet Science Academy, Moscow, 1960.

I.A. Viktorov, "Effects of Incompleteness of Propagating Surface for Raley Surface Acoustic Wave," Soviet Science Academy Reports, vol. 119, 3, 1958, pp. 463–465.

*Primary Examiner*—Benjamin R. Fuller
*Assistant Examiner*—C. Dickens
*Attorney, Agent, or Firm*—Oliff & Berridge, PLC

[57] ABSTRACT

An ink-jet recording apparatus jetts an ink droplet from a free surface of an ink material by propagating a surface acoustic wave. The apparatus includes a substrate, a slant face formed on the substrate, The slant face contacts the ink material with a grade in use. A vibration generator for generating plural surface acoustic waves, is formed on the substrate away from the ink material in use, and the plural surface acoustic waves are propagated along with the substrate and changed into plural longitudinal waves having propagating directions in the ink material. The propagating directions will be concentrated at a certain portion within the ink material.

24 Claims, 13 Drawing Sheets

METHOD AND APPARATUS FOR REDIRECTING PROPAGATING ACOUSTIC WAVES FROM A SUBSTRATE TO A SLANT FACE TO CAUSE INK-JETTING OF INK MATERIAL

BACKGROUND OF THE INVENTION

This invention generally relates to an ink-jet recording method and an ink-jet recording apparatus using the same. More specifically, the invention relates to an ink-jet recording method for recording an image on a recording sheet by generating a Rayleigh surface acoustic wave (SAW), providing an ink material on a propagation path of the SAW, jetting a droplet of the ink material by the SAW and adhering the ink droplet onto the recording paper.

Several on-demand type ink-jet recording apparatuses for recording an image by jetting ink droplets from plural orifices have been proposed. Typical on-demand type ink-jet recording apparatuses are known as the piezoelectric transducer-type ink-jet recording apparatus or the thermal ink-jet apparatus.

In the piezoelectric transducer-type ink-jet recording apparatus, an image is formed by changing the inner pressure of ink material loaded in an ink reservoir by deforming a piezoelectric element located in the ink reservoir, jetting ink droplets from a nozzle connected to the ink reservoir and forming imaging dots on the recording paper. In the thermal ink-jet recording apparatus, an image is formed by producing a bubble in an ink material loaded into an ink reservoir by heating the ink material by a heating element located within the ink reservoir, jetting ink droplets from a nozzle connected to the ink reservoir by the generating pressure of the bubble and forming imaging dots on the recording paper.

By using those ink-jet recording methods, typically an image having 300 dot per inch (dpi) image resolution or higher image resolution such as 600 dpi or 720 dpi may be obtained. However, much higher image resolution for the ink-jet recording apparatus has also been required.

It is necessary to reduce the diameter of ink droplets to achieve such high resolution. Typically, the nozzle diameter is set to a much smaller diameter to make the recording dot small, however, the small nozzle diameter also induces inner-nozzle clogging problems due to foreign matters or dried ink material residing in the nozzle, or the small nozzle diameter may also cause a direction changing problem of the jetting ink due to adhering of the ink residue around the ink nozzle. As a result, image defects on the recording paper may occur.

It is not always a good way to reduce the nozzle diameter to reduce the recording dot because there is a certain lower limit of the nozzle diameter ensuring both such higher resolution and quality of the recorded image.

Recently, a new ink-jet recording method, different from the aforementioned piezoelectric-type or the thermal-type ink-jet recording, utilizing a surface acoustic wave (SAW) has been proposed. A surface acoustic wave, which transports all of its energy within a depth of one wavelength thereof from the surface of a solid wave transporting medium, is generally referred to as a Rayleigh surface acoustic wave. If liquid is existing on the surface of the wave transporting medium, the Rayleigh surface acoustic wave leaks out into the liquid and is attenuated at the solid surface thereof. Thus, the Rayleigh surface acoustic wave is released at the liquid surface as an energy form of liquid supersonic wave while the Rayleigh surface acoustic wave is still transporting in the transporting medium. The liquid supersonic wave is generally referred to as a leaked Rayleigh surface acoustic wave. At this time, a longitudinal wave is released into the liquid with a certain angle direction. By using such phenomenon for transporting the energy as a specific wave form, ink droplets will be produced in the liquid and are jetted onto the recording paper.

According to this feature, as the ink jetting opening does not have to be a form of orifice or nozzle or should not have the same diameter as the ink droplet, the diameter of the ink droplet is not affected by the diameter of the ink nozzle. Also, the ink jetting nozzle does not have to be formed as a shape of circular nozzle but may be formed as a slit. The shape of the ink jetting opening will not be a critical matter on this system.

Ink-jet recording system utilizing the Rayleigh surface acoustic wave is disclosed in Japanese unexamined patent publications (JP-A) 54-10731 (1979) and 62-66943 (1987). In those systems, surface acoustic waves are generated by interdigital electrodes positioned within the ink liquid and the liquid ink is vibrated by the leaked Rayleigh surface acoustic waves to form ink droplets to be discharged from the ink jetting opening like a nozzle.

In this system, deterioration of the ink material or the interdigital electrodes tend to occur because the interdigital electrodes directly contact the ink material so that the electrodes and the ink material react with each other to melt the electrode material or to adhere ink residues onto the electrodes. Also the energy transporting efficiency is relatively low because the longitudinal wave generated by the leaked Rayleigh surface acoustic wave on the solid transporting medium tend to be easily reduced within the ink liquid.

To avoid such problems, other ink-jet recording systems having interdigital electrodes that do not directly contact the ink material are proposed and disclosed in the examined patent publications (JP-A) 2-269058 (1990) and 4-14455 (1992).

FIG. 19 is an explanatory view of the principal structure of the conventional ink-jet recording method utilizing the surface acoustic wave. In FIG. 19, 31 is the surface, 32 are the interdigital electrodes, 33 is the piezoelectric plate, 34 is the ink, 35 is the ink droplet, and 36 is the high frequency power source. The interdigital electrodes are formed onto the surface 31 of the piezoelectric plate 33. When the high frequency voltage from the power source 36 is applied to the interdigital electrodes 32, surface acoustic waves are generated and are transported through the surface 31 of the piezoelectric plate 33. Once the ink 34 is placed onto a propagating path of those surface acoustic waves, the vibrating energy of the surface acoustic wave will be transferred onto the ink 34 to produce an ink droplet 35 to be ejected.

There is no ink supplying mechanism in this principal FIG. 19. Therefore there is no way to refill the ink 34 after the ink has been fully consumed so as to continuously produce ink droplets for recording. JP-A 2-269058 discloses a capillary for the purpose of the refilling of the ink. JP-A 4-14455 discloses a slit for providing the ink material continuously on the propagating path of the piezoelectric element.

The systems disclosed in JP-A 2-269058 and JP-A 4-14455 have relatively high reliabilities because the ink does not directly contact the interdigital electrodes, and the ink jetting opening does not have to be formed as a small orifice as small as the produced ink droplet. In addition, generated energy of the surface acoustic wave will be efficiently used as the ink jetting energy because attenuation of the surface acoustic wave will be maintained minimal until the waves contact the ink material, and an actual transporting distance of the leaked longitudinal wave within the ink will also be very short.

However, ink-jet systems utilizing such leaked Rayleigh surface acoustic wave still have a problem that ink discharging condition will be changed based on the positional relationship between the propagating path and the provided ink material.

The characteristic of the leaked Rayleigh acoustic waves as being a longitudinal wave leaked from a solid surface that propagates the surface acoustic wave, as well as the jetting phenomenon of the produced ink droplets has been reported in detail for example in DENSHI-TSUSHIN GAKKAI GIJYUTSU HOKOKU US89-51, pp41–46. According to the analysis of the author of this article, the angle of the longitudinal wave leaked from the solid surface material or Inter-Digital Transducer (IDT) on the surface of the solid surface is estimated as the following equation:

$$\text{Leaked Rayleigh angle } \alpha = \sin^{-1}(Vi/Vw)$$

Wherein, Vw is the velocity of the leaked surface acoustic wave on the solid surface which contacts to the liquid contacting to liquid, and Vi is the velocity of the longitudinal wave transporting within the liquid. This angle is primarily estimated as, for example $\alpha$ is 23° in the system using water as the liquid and the $LiNbO_3$ having 28° Y-plate-X transporting as the solid. This value was also confirmed by actual experiment. The phenomenon of the leaking of the longitudinal wave into the liquid from the solid surface occurs at the same time when the surface acoustic wave propagating on the solid surface contacts the liquid. The surface acoustic wave (leaked surface acoustic wave or leaked Rayleigh wave) on the surface of the solid will be attenuated within a length equal to a few wavelengths in the liquid when the surface is immersed into the liquid. Therefore, a producing position of the ink droplet and a jetting direction of the generated ink droplet will be easily affected by the actual contacting position between the liquid and the solid surface, which also affects the generating position of the longitudinal wave that will be transported in the liquid. Therefore, it is impossible to produce dots accurately on the recording paper due to the inaccuracy of the jetting position of the ink droplets unless the amount of the providing ink and the providing position of the ink is accurately controlled in the system of JP-A 2-269068 or surface position is accurately controlled of the liquid ink in the system of JP-A 4-14455.

In addition, it is necessary to shorten the width d of the interdigital electrodes 32 to reduce the diameter of the produced ink droplets in the conventional system disclosed in FIG. 19. However, if the width d is decreased to be not more than 1/10 width of the wavelength $\lambda$ of the surface acoustic wave to be generated, a directivity of the transporting direction of the surface acoustic wave will be much worse. Also, the worse directivity enhances the occurrence of unnecessary vibration sufficient to produce cross-talk on the liquid surface and instability of the jetting direction of the droplets.

To produce relatively small droplets without such problems, it is plausible to maintain the width d to be not less than 10 times of the wavelength $\lambda$ of the surface acoustic wave by shortening the wavelength $\lambda$ of the surface acoustic wave (to generate a relatively high wave) and by narrowing the width d. However, the oscillating frequency will be inaccurately high sufficient to produce alternate drawback such as a requirement of relatively expensive high frequency power source. This is not a critical solution of the aforementioned problems. Thus, it is still difficult to accurately produce relatively small ink droplets and to jet the droplets onto the recording sheet.

SUMMARY OF THE INVENTION

One object of this invention is to provide an ink-jet recording apparatus capable of producing stable small ink droplets and jetting the droplets accurately onto the recording sheet in order to produce an accurate recording image regardless of the provided position of the ink while the advantage of the ink-jet printing method utilizing the leaked Rayleigh surface acoustic wave is maintained.

Another object of the present invention is provide an improved ink jet recording apparatus and an improved ink jet recording method using the same for jetting an ink droplet from a free surface of an ink material by propagating a surface acoustic wave. The apparatus includes a substrate, a slant face formed on the substrate, the slant face contacting the ink material with a grade in use, a vibration generator for generating plural surface acoustic waves, the vibration generator being formed on the substrate away from the ink material in use, and the plural surface acoustic waves are propagated along with the substrate and changed into a plural longitudinal waves having propagating directions in the ink material, the propagating directions being concentrated at a certain portion within the ink material.

DETAILED DESCRIPTION OF PREFERRED EMBODIMENTS

The principal explanation of the present invention will be described firstly. A longitudinal wave irradiated from a solid surface, which is a propagating medium of the acoustic surface wave, at the contacting point with the liquid has relatively high directivity even in the liquid because the longitudinal wave itself has relatively high directivity about the propagating characteristic as a leaked Rayleigh wave. Also, this irradiation has extremely high energy density at the near contacting portion with the liquid because the surface acoustic wave propagating in the solid surface immediately irradiates its energy as a form of longitudinal wave within a distance of a few wavelengths from the contacting point when the surface acoustic wave hits the liquid surface. In addition, an energy conversion efficiency from the surface acoustic wave to the longitudinal wave in the liquid is also extremely high compared to other kinds of inter-wave energy conversion.

Therefore, it is possible to concentrate the energy at the near surface of the liquid by irradiating the longitudinal wave from the propagating surface of the surface acoustic wave to the liquid so that the propagating direction of the longitudinal wave will be substantially parallel to the liquid surface, and the irradiation is set to occurr simultaneously at the plural portions around a jetting point of the ink. Since this kind of concentration of the energy occurs at the near surface of the liquid, the total amount of the liquid to be energized will be extremely small and the liquid becomes extremely high energy relative to its small amount of volume. Thus, extremely small droplets are jetted from the liquid surface with relatively high speed, and the jetted droplets will make a detailed and precise image.

Figure 4A:
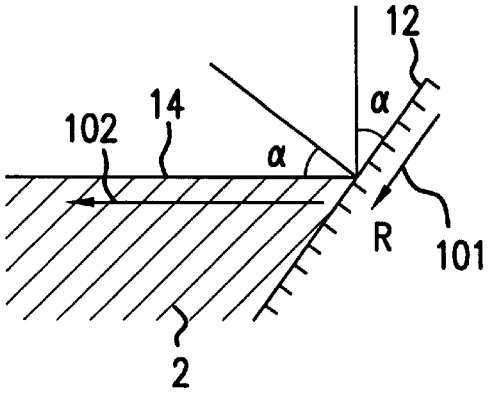
FIGS. 4(*a*) and (*b*) are both explanatory views of the relationship between the surface acoustic wave and the generated longitudinal wave.
Figure 4B:
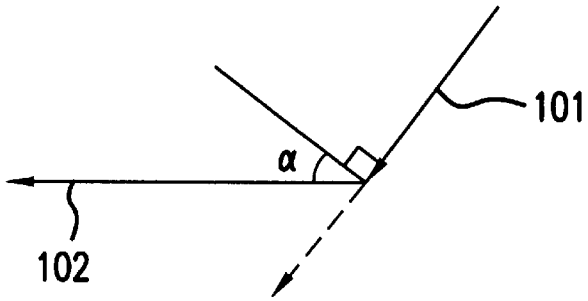

A method to propagate the longitudinal wave parallel to the liquid surface for accomplishing such high energy conversion will be explained. FIGS. 4(*a*) and 4(*b*) are explanatory views of the relationship between the surface acoustic wave and the longitudinal wave. As indicated in FIG. 4(*a*), when the surface acoustic wave is propagated from the solid surface to the contacting portion between the solid and the liquid, the longitudinal wave is irradiated from the solid into the liquid. The direction of the irradiated longitudinal wave is theoretically constant which is within 90 degrees with regard to the propagating direction of the surface acoustic wave.

This is also understandable form the equation of the leaked Rayleigh angle $\alpha$ mentioned above. FIG. 4(*b*) discloses such phenomenon. When the solid surface has a slant face gradually opened corresponding to the distance from the liquid surface and the surface acoustic wave is irradiated from the slant face into the liquid as indicated in FIG. 4(*a*), the longitudinal wave is propagated to a direction far away from the slant face providing a direction component parallel to the liquid surface. In other words, the propagating surface of the surface acoustic wave has a specific shape such that the cross-sectional area thereof increases along with the ink jetting direction. When the liquid surface and the propagating surface of the surface acoustic wave has a specific angle relationship (constant) at the near liquid surface, the propagating direction of the longitudinal wave in the liquid will be controllable. Especially, the angle defined by the propagating surface of the surface acoustic wave and a perpendicular line of the liquid surface is set to the leaked Rayleigh angle $\alpha$, and the longitudinal wave will be propagated along with the liquid surface. Numbers 101 and 102 indicate propagating directions of the surface acoustic wave and the longitudinal wave, respectively.

As the surface acoustic wave attenuates immediately after the wave contacts the liquid, the propagating surface of the surface acoustic wave may have any optional shape at anywhere other than near the contacting portion between the liquid and the surface. For example, the propagating surface may be formed continuously to any other plane. Also, beneath of the liquid, the propagating surface may be formed as a perpendicular plane to the liquid surface. However, at the near contacting portion between the liquid and the propagating surface, the propagating surface (slant face) preferably has the specific-angle relationship to the liquid surface within a specific distance range from the liquid surface. This feature ensures the specific-angle relationship thereof for generating the longitudinal wave substantially parallel to the liquid surface constantly even if the liquid surface is changed in its altitude.

Figure 5A:
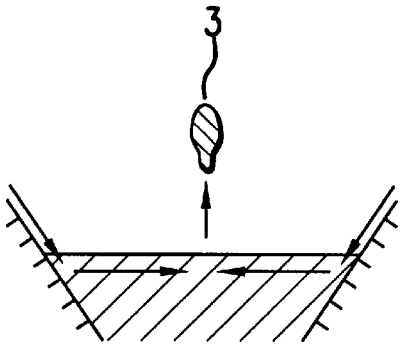
FIGS. 5(*a*) and (*b*) are both explanatory views of the transmission of the surface acoustic waves from plural directions.
Figure 5B:
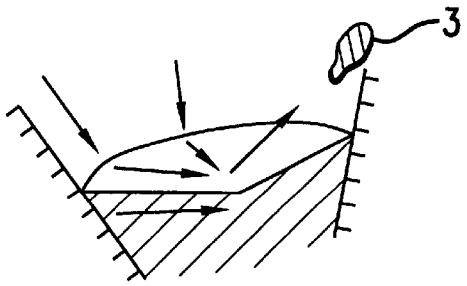

A method how to concentrate the energy of the longitudinal waves will be described. FIGS. 5(*a*) and 5(*b*) are an explanatory views of the surface acoustic waves propagated from plural directions. The portion having the aforementioned specific-angle relationship to the liquid is preferably formed along with the propagating path of each surface acoustic waves. For example, as indicated in FIG. 5(*a*), plural longitudinal waves are concentrated by confronting the propagating surfaces of each other to form a portional slit shape. Otherwise, if the plural longitudinal waves generated from the different portions are concentrated as indicated in FIG. 5(*b*), ink droplets will also be discharged from the liquid surface. As an alternative way of concentrating of the longitudinal waves, plural waves generated from the conical surface like an funnel may be concentrated with each other on the center line of the cone at the surface of the liquid. This configuration will be explained in detail later. In this case, an unlimited number of the longitudinal waves will be concentrated at the center portion. Other shapes such as an elliptical cone shape or a polygonal cone shape may also be adopted as the propagating surface. Other surfaces where the surface acoustic wave is not propagated may have any kind of shape and may not have the specific-angle relationship with the liquid.

To utilize the energy of plural waves in a concentrated state, each wave should be concentrated at a point with same phase of the wave. To accomplish the energy concentration, the propagating surfaces of each wave are preferably arranged symmetrically to each other. In addition, those propagating surfaces are preferably placed so that the reaching time of each wave will be same timing on the point at the ink surface in order to concentrate the vibrating energy. The reaching time t of each wave from each propagating surface to the specific point is defined by the following equation:

$$t=r1/v1+r2/v2$$

wherein r1 and v1 are, respectively, the propagating distance and the propagating velocity of the wave on the propagating surface, and r2 and v2 are, respectively, the propagating distance and the propagating velocity of the wave in the liquid. Each propagating surface should be arranged so that t will be constant with regard to each wave. According to this method, as an advantage, each propagating surface can be driven by one common vibrating source to simplify the structure.

The design of the propagating surface is further simplified if the material of the propagating surface has a uniform and isotropic characteristic with respect to the propagating wave and if the aforementioned equation is applied thereto. In this case, the values of r1 and r2 will be set to a constant value by arranging several propagating surfaces at equal-distance portions from the concentrating point of the energy. The simplest configuration to accomplish the above relationship is to place a circular or circular arc propagating surface around a central axis thereof and ink material. This configuration will be explained in detail later.

Another configuration may also be adopted to make the reaching time t of each wave constant. For example, the cross sectional shape of the propagating surface perpendicular to the jetting direction of the liquid may be formed as a circular or an elliptic shape or a slit-like shape. Also the reaching time t of the wave will be maintained constant by adjusting the distance r2 even when the r1 is not the same with respect to plural propagating surfaces or vice versa.

This is the same function with that of an acoustic lens system. However, according to the invention, the same function will be accomplished without any acoustic lens system. For example, by utilizing a simple configuration of a linear vibrating means and a circular or elliptic opening, the vibrating energy may be concentrated at a specific portion within the opening so easy. In this case, the linear vibrating means can be used instead of circular vibrating means, Therefore, variation of the material of the piezoelectric substrate will be obtained and high integration of the device will also be plausible.

As an alternative way to concentrate the energy of plural waves, several vibrating means each of which generate unique wave having a unique reaching time t may also be used by overlapping phases of each wave upon each other at a specific point. Those vibrating means may be driven by an independent driver alternatively in a specific timing with one another. Time sharing driving of the device may be performed and thus the total driving power of the device will be reduced. As an alternative way, a longitudinal wave that was once released from a propagating surface and reflected by a specific surface may also be used for the concentrating purpose of the energy at a specific point of the liquid surface.

The distance between the generating portion of the longitudinal wave and the jetting portion of the liquid is preferably set to be relatively small because the energy loss of the longitudinal wave in the liquid is relatively higher than that of the surface acoustic wave on the propagating surface. The distance between the generating portion of the surface acoustic wave and the contacting portion with the liquid surface is not critical in terms of the efficient transmitting of energy. However, in terms of the diffusion of the energy, the distance should not be set to be unnecessarily long.

Figure 1:
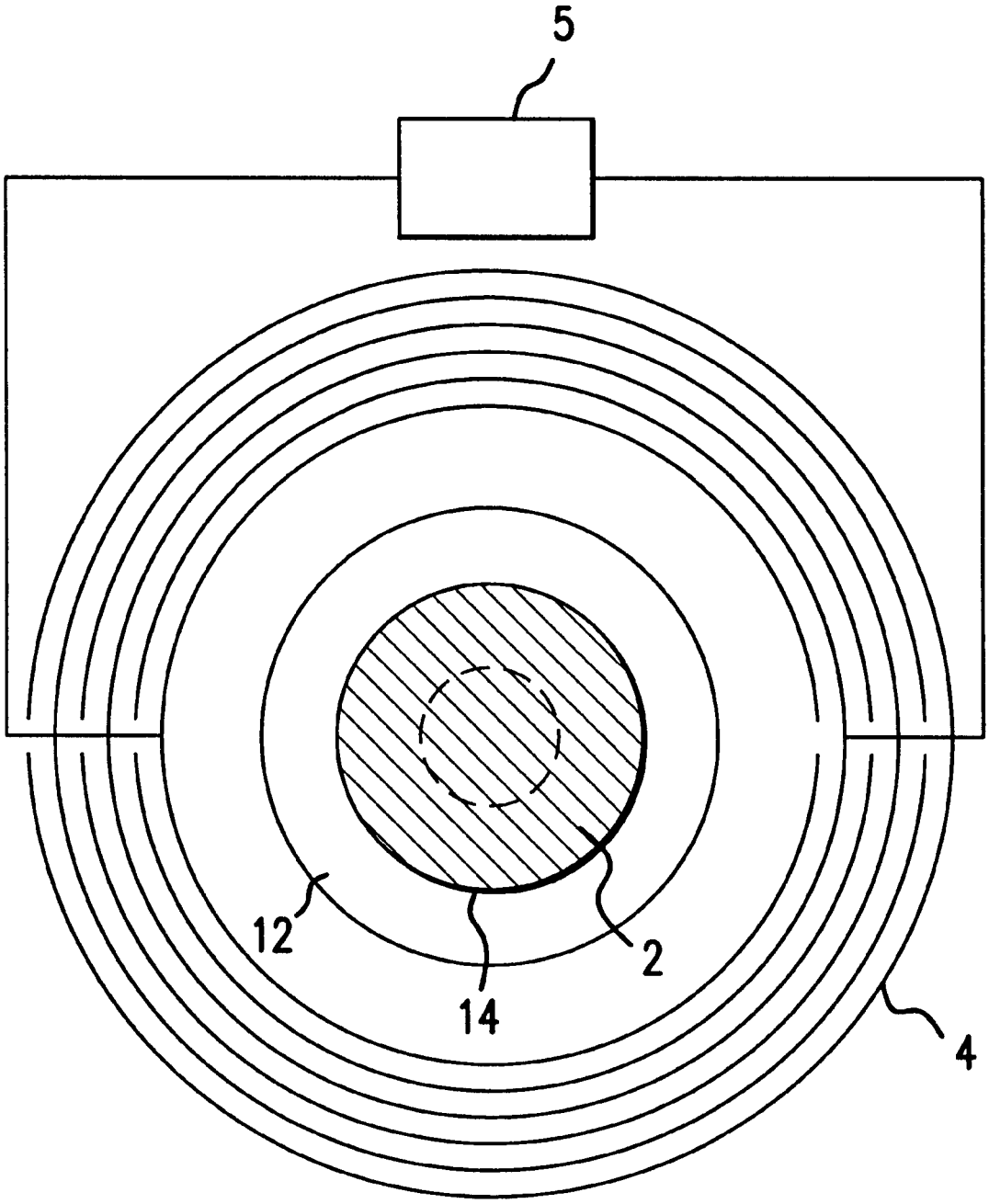
FIG. 1 is a plan view of the principal structure of the recording head of the first embodiment of the present invention.
Figure 2:
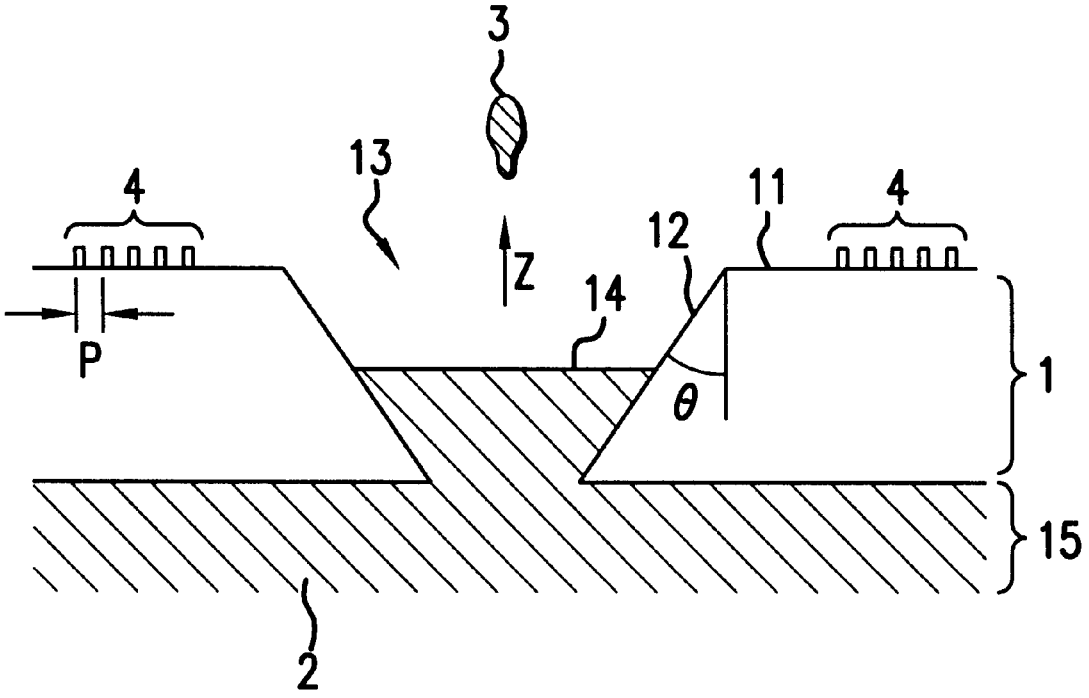
FIG. 2 is a sectional view of the recording head of the first embodiment of the present invention.
Figure 3:
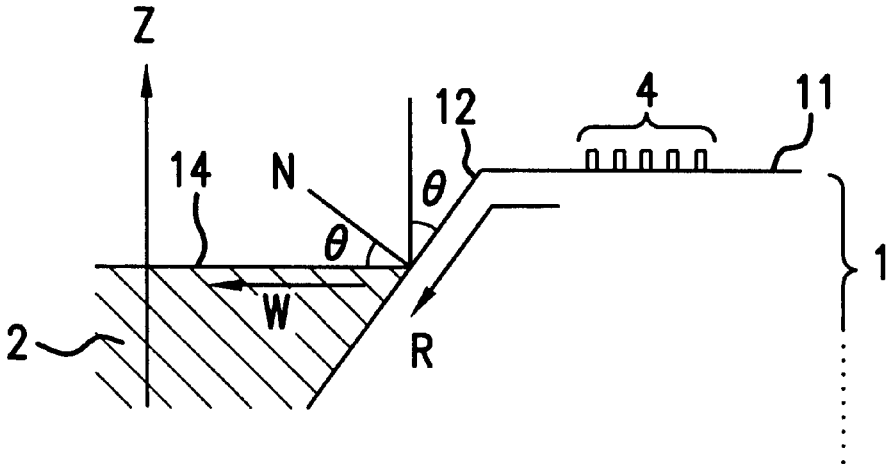
FIG. 3 is a portionally enlarged view of near liquid surface of the opening of the recording head of the first embodiment of the present invention.

FIG. 1 is a plan view of the essential configuration of the recording head of the first embodiment of the present ink-jet recording apparatus, FIG. 2 is a cross-sectional view thereof and FIG. 3 is the portionally enlarged cross-sectional view of the opening near the liquid surface. In those figures, 1 is a piezoelectric substrate, 2 is an ink material, 3 is an ink droplet, 4 are interdigital electrodes, 5 is a high frequent power source, 11 is a surface of the piezoelectric substrate, 12 is a propagating surface, 13 is an opening, 14 is liquid surface, and 15 is an ink container.

As disclosed in FIG. 2, an ink container (ink providing room) 15 is formed beneath the piezoelectric substrate 1. An opening 13 communicating the ink container 15 and the surface of the piezoelectric substrate is defined by the piezoelectric substrate 1. The ink 2 is maintained within the ink container 15 by controlling the pressure or suction force of the ink by providing a mechanism (not shown) so as to maintain the ink surface 14 at the opening 13, of the ink jetting portion. The interdigital electrodes 4 are formed on the surface of the piezoelectric substrate around the opening 13, and the interdigital electrodes 4 are electrically coupled to the high frequency power supply 5 so that the high frequency will be applied thereto.

The piezoelectric substrate 1 is constituted from the material indicating a mechanical strain upon the application of an electric field such as Lithium niobate, lead titanate zirconate (PZT), zinc oxide or other piezoelectric polymer films such as polyvinylidenefluoride. As Lithium niobate and PZT have an in-plane anisotropy for the propagating speed of the surface acoustic wave, zinc oxide, polycryatalline PZT and polymer piezoelectric films are preferably used for the material of the substrate in terms of the easiness of the device design.

The piezoelectric substrate itself may be constituted from the aforementioned material as a whole, otherwise, it may be constituted by applying a piezoelectric layer on a metal substrate, semi-conductive substrate, inorganic insulative substrate or resin substrate by coating, vapor deposition or bonding methods. This is why the propagating energy of the surface acoustic wave will be stored within a thickness of 1.0λ from the surface of the piezoelectric substrate providing the wavelength of the surface acoustic wave is λ. However, to make sure the propagation of the surface acoustic wave, the thickness of the piezoelectric layer is preferably set to be not less than few times of the wavelength λ of the generating surface acoustic wave, more preferably set to be not less than ten times thereof. These actual thicknesses are not less than 20 μm, preferably not less than 500 μm, respectively. The piezoelectric substrate formed by applying insulating layers such as $SiO_2$ or SiN and ZnO thin film on the silicon substrate may also be used.

The interdigital electrodes 4 may be formed on the surface 11 of the piezoelectric substrate 1 by using a conventional film forming method such as a photolithographic method or the like. The pitch P of the interdigital electrodes is preferably set to be a multiple number of the ½λ of the surface acoustic wave to be generated which is defined by the vibrating frequency and the property of the piezoelectric material to oscillate the wave efficiently. The pitch P is preferably set to be within from 2 μm to 300 μm. The interdigital electrodes 4 are actually configured as several pairs of concentric electrodes each of which is coupled to different potential alternatively as indicated in FIG. 1. The number of the pairs of the interdigital electrodes is estimated by the magnitude of the power of the high frequency power source 5 or a required ink-jetting speed or the like. For example, the actual number of pairs are set to from 2 to 200.

The opening 13 is formed concentrically with the interdigital electrodes 4. The side wall of the opening portion 13 will be a propagating surface 12 of the surface acoustic wave. The propagating surface is configured as a slope having a slope angle θ against to the perpendicular line of the liquid surface 14. The surface 11 of the piezoelectric substrate and the propagating surface 12 of the opening 13 are continued acoustically so as to propagate the surface acoustic wave directly. When forming of the opening 13 onto the piezoelectric substrate, several conventional methods such as an etching method, laser processing method, electrically discharging machining method, drill opening and punching method or the like may be used.

As indicated in FIG. 3, the surface acoustic wave generated by the interdigital electrodes 4 is propagated from the surface 11 of the piezoelectric substrate to the propagating surface 12 of the opening 13 along the direction R. Then, at the propagating surface 12, the longitudinal wave is irradiated to the ink 2 therefrom. The propagating direction (along with the direction W in FIG. 3) of the longitudinal wave is a direction having an angle θ against to the normal direction (along with the direction N in FIG. 3) of the propagating surface. The angle θ is equal to a leaked Rayleigh angle which is defined by the equation $\alpha=\sin^{-1}(Vi/Vw)$ wherein Vw is a velocity of the leaked surface acoustic wave on the surface of the propagating surface and Vi is a velocity of the leaked longitudinal wave in the liquid. In this embodiment, the propagating direction of the longitudinal wave is set to be parallel to the free surface of the ink 2.

For example, when the ink 2 including 10 percent of copper phthalocyanine dye in water was used, the Vi of the longitudinal wave was 1400 m/sec. On the other hand, the velocity of the surface acoustic wave at the propagating surface Vw was 4000 m/sec. At this time, theoretically, the leaked Rayleigh angle α was estimated as 20.5°. This angle is also estimated by observing a leaked longitudinal wave from the propagating surface to the ink using a Schlieren photograph of a surface perpendicular to the interface surface between the propagating surface of the surface acoustic wave and the ink material when the ink is contacted to the propagating surface. Thus, the angle θ of the propagating surface 12 is set to be 20.5° in response to the estimated angle α in this embodiment.

All of the whole acoustic surface waves generated by the substantially circular shaped interdigital electrodes are propagating and directed to a center portion. Then the waves contact the ink material 2 via propagating surface 12 around the opening 13 and are leaked as the longitudinal wave in the ink material. The longitudinal waves are also propagating along with the liquid surface 14 directing to the center portion of the opening 13. Therefore, all generated longitudinal waves are concentrated at the center portion of the opening 13. Thus, concentrated energy at the center portion generates an ink droplet 3 and discharges it along the perpendicular direction to the ink surface 14.

In this embodiment, as an working example, the ink and the angle of the propagating were selected as described above. The viscosity of the ink was set to 3 CP (3 mPa·s). A constant pressure of 0.01 $N/cm^2$ was applied to the ink by the pressure applying source (not shown) to maintain the ink surface within the opening 13.

As the concentric configuration of the interdigital electrodes was used in this embodiment, the acoustic surface waves were propagated directed toward the center of the concentric center. Therefore, as the material of the piezoelectric substrate, an isotropic material is preferably used to enhance the propagating efficiency. Thus, polyvinylidene-fluoride film having a 100 μm thickness was actually used. The interdigital electrodes 4 were formed by conventional photolithographic method. The pitch P of the interdigital electrodes is set to be about 50 μm, and eight pairs of interdigital electrodes were arranged. The drive pulse having a basic frequency of 10 MHz, 10 V voltage was applied at the 5 KHz high frequency. The diameter of the opening at the surface of the piezoelectric surface 11 was 500 μm and the distance between the innermost interdigital electrode and the peripheral portion of the opening was set to be 200 μm.

Ink jetting experiment was performed by using the above condition. The ink droplets were jetted to the perpendicular direction to the ink surface accurately and stably. The diameter of the ink droplets were sufficiently small compared to the conventional ink-jet apparatus using a parallel-type interdigital electrodes.

Figure 6:
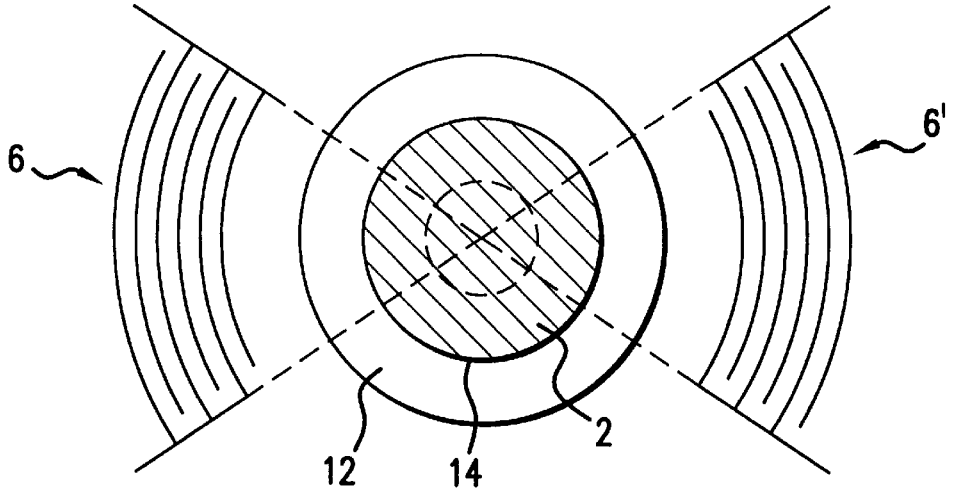
FIG. 6 is an explanatory view of the principal structure of the recording head of the second embodiment of the present invention.

FIG. 6 is a plan view of the principal structure of the recording head of the second embodiment of the present invention. The cross-sectional shape of the recording head is omitted from the drawing because it is the same with that of the embodiment 1 as shown in FIG. 2. Explanations for elements the same as those of the embodiment FIG. 2 are omitted for clarity. Interdigital electrodes are labeled with reference number 6, 6'. Although the interdigital electrodes 6, 6' have a similar shape with the interdigital electrodes 4 of the first embodiment, in this embodiment, however, the interdigital electrodes are formed having a shape of plural pairs of the electrodes each of which has circular arc shape. Interdigital electrodes 6, 6' are arranged to form a concentric circle. The center of the concentric circle is also the center of the opening 13. The configuration of the interdigital electrodes 6, 6' other than its arrangement is the same with the interdigital electrodes 4 of the first embodiment. Also, the configuration of the piezoelectric substrate 1 and the opening 13 is the same as those of the first embodiment.

Several surface acoustic waves generated by the interdigital electrodes 6, 6' are propagated and directed to the center of the opening 13. Then, the waves are converted into the longitudinal waves by contacting to the ink 2. Each of the longitudinal waves are also propagated and directed to the center of the opening. By concentrated energy of those longitudinal waves, ink droplets are formed and jetted to a direction perpendicular to the ink surface.

Such kind of energy concentration mechanism using the circular arc interdigital electrodes are known in IEEE Transaction on Ultrasonics, Ferroelectrics, and Frequency Control, Vol.36, No.2, 1989, pp178–184. However, in this embodiment of the present invention, in addition to the energy concentration using the above configuration of the interdigital electrodes, the energy efficiency is also increased due to the irradiation of the longitudinal waves substantially parallel to the liquid surface at the contacting portion with ink surface.

In this configuration, the interdigital electrodes 6, 6' were formed in a symmetrical shape with respect to the center of the opening 13. By driving the electrodes 6 and 6' at the same electric condition, the longitudinal wave generated based on the surface acoustic wave of the electrode 6 and that of the electrode 6' are concentrated at the center portion of the opening 13. If the driving condition of those electrodes 6 and 6' are different each other, the jetting direction of the ink droplets will be shifted from the perpendicular direction to the ink surface. By using this characteristic, the jetting direction of the ink droplets will be controlled.

The distances between the center portion of the opening 9 and each of the interdigital electrodes 6 and 6' are changeable. In this case, the energy of each of the longitudinal waves is concentrated at a portion defined by the velocity of the surface acoustic surface and the velocity of the longitudinal waves. Thus, the device may be designed taking those facts into account. In addition, this method also can be applied to the design of the matching of the phase of each waves.

A pair of interdigital electrodes 6, 6' are placed symmetrically as disclosed in FIG. 6, but more than two interdigital electrodes may also be placed. By arranging those electrodes in a symmetric manner, ink droplets will be jetted along with the perpendicular direction to the ink surface.

Figure 7:
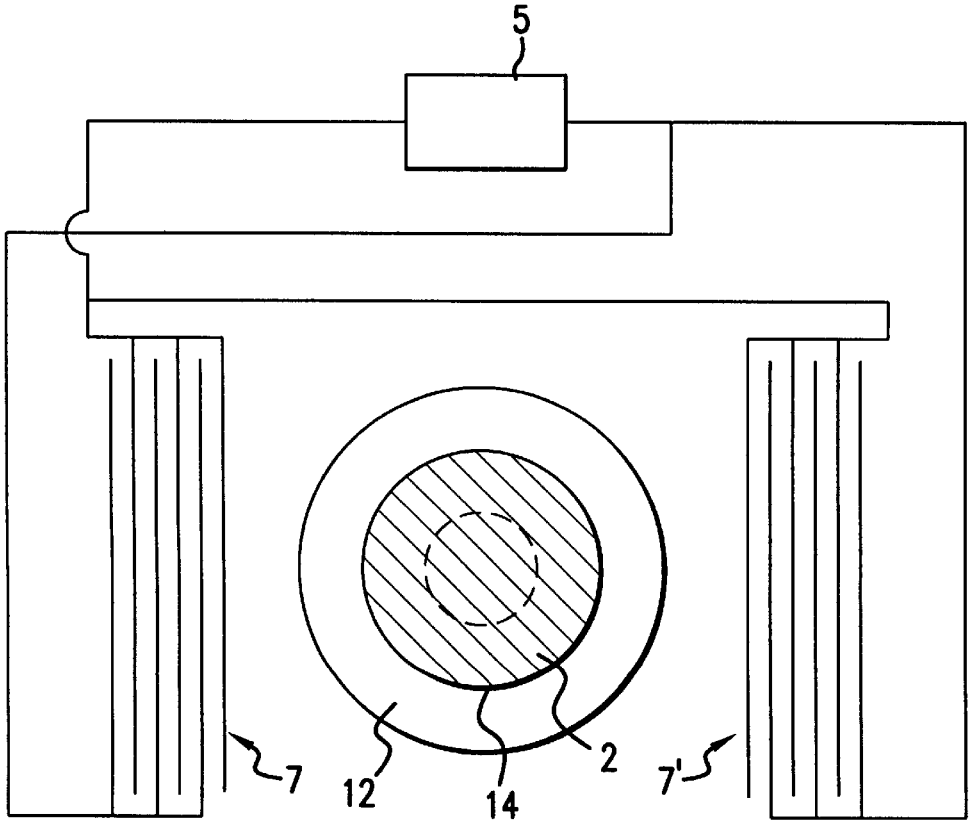
FIG. 7 is an explanatory view of the principal structure of the recording head of the third embodiment of the present invention.

FIG. 7 is a plan view of the principal structure of the recording head of third embodiment of the present invention. The cross-sectional shape of the recording head is omitted from the drawing because it is the same with that of the first embodiment as shown in FIG. 2. Explanations for elements the same as those shown in FIG. 2 are omitted, and reference numbers 7, 7' indicate interdigital electrodes. In this embodiment, the configuration of the recording head other than the interdigital electrodes is the same with that of the first embodiment.

In this embodiment, linear interdigital electrodes 7, 7' are symmetrically arranged at both sides of the opening 13. The opening 13 has the same shape as shown in the first and second embodiment, the shape being a conical, funnel-like shape. The side portion of the opening 13 is acoustically coupled as a propagating surface to the surface of the piezoelectric substrate. The side portion of the opening 13 adjusts the angle θ with the perpendicular line of the ink surface.

The surface acoustic waves generated from the interdigital electrodes 7, 7' are propagated in confronting directions from each other, and are converted into the longitudinal waves at the propagating surface of the opening 13 by contacting the ink 2. The longitudinal waves are propagated parallel to the ink surface and are concentrated to make ink droplets and jet them therefrom.

The distances between the center portion of the opening 13 and each of the interdigital electrodes 7 and 7' are changeable. In this case, the energy of each of the longitudinal waves is concentrated at a portion defined by the velocity of the surface acoustic surface and the velocity of the longitudinal waves. Thus, the device may be designed taking those facts into account. In addition, this method also can be applied to the design of the matching of the phase of each of the waves.

The interdigital electrodes 7, 7' were formed by conventional photolithographic method. The pitch P of the interdigital electrodes was set to about 50 μm and eight pairs of interdigital electrodes were formed. The lengths of the interdigital electrodes were 800 μm. A drive pulse having a basic frequency of 10 MHz, 10 V voltage was applied at the 5 KHz high frequency. The diameter of the opening at the surface of the piezoelectric surface 11 was 500 μm and the distance between the innermost interdigital electrode and the peripheral portion of the opening was set to 200 μm. The viscosity of the ink was set to 3 CP (3 mPa·s). A constant pressure of 0.01 $N/cm^2$ was applied to the ink by the pressure applying apparatus (not shown) to maintain the ink surface within the opening 13.

An ink jetting experiment was performed by using the above condition. The ink droplets were jetted to the perpendicular direction against to the ink surface accurately and stably. The diameter of the ink droplets were sufficiently small compared to the conventional ink-jet apparatus using a parallel interdigital electrodes.

The arrangement of the interdigital electrodes may be a circular, circular-arc or linear shape as indicated in the first through third embodiments or any other kind of shape. However, if the linear arrangement is adopted, as only the energy of the few waves are concentrated at the center of the opening 13, energy efficiency is relatively low compared to those of the circular arrangement. Therefore, the circular or circular-arc arrangement is much better to use in terms of the ink jetting.

Figure 8:
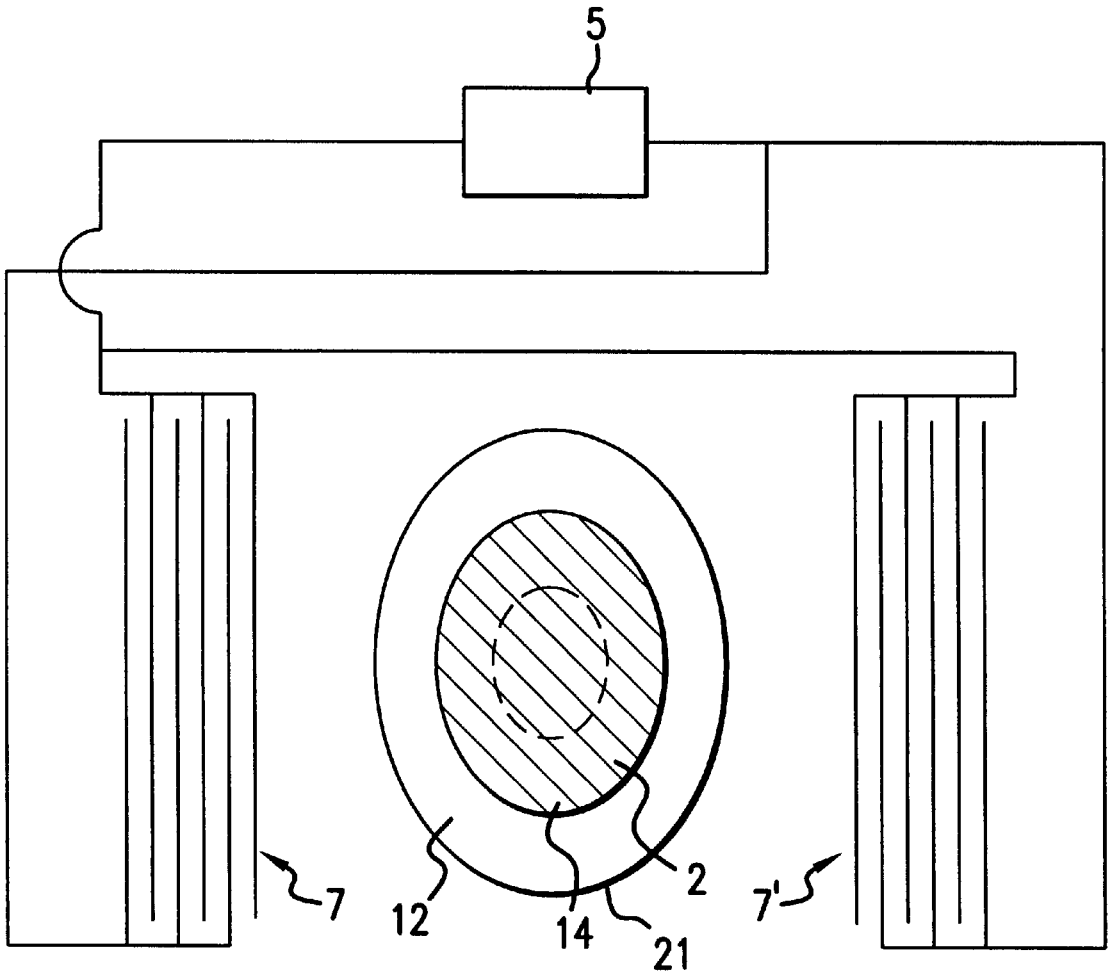
FIG. 8 is an explanatory view of the principal structure of the recording head of the fourth embodiment of the present invention.

FIG. 8 is a plan view of the principal structure of the recording head of the fourth embodiment of the present invention. The cross-sectional shape of the recording head is omitted from the drawing because it is the same with that of the first embodiment as shown in FIG. 2. Explanations for the same elements with those of the FIG. 1 and FIG. 7 are also omitted, and reference number 21 is an opening. The configuration of this embodiment other than the shape of the opening 21 is the same with that of the aforementioned third embodiment.

As indicated in FIG. 8, in this embodiment, the opening 8 is formed as an elliptic shape. At both sides of the minor axis of the ellipse of the opening 21, linear interdigital electrodes 7, 7' are arranged in opposed relation similar to those of the third embodiment. The side wall of the elliptic opening 21 is configured so that the wall adjusts the angle θ with the perpendicular line of the ink surface in order to propagate the longitudinal wave parallel to the liquid surface.

The length of the major axis and the minor axis of the opening 21 are 600 μm and 549 μm, respectively. The distance between the innermost interdigital electrodes 7, 7' and the peripheral portion of the opening 21 was set to be 200 μm. An ink jetting experiment was performed by applying an ink material 2 into the opening 21 with the same condition with those of the embodiment 3. The ink droplets were jetted to the perpendicular direction of the link surface accurately and stably and the diameter of the ink droplets was sufficiently smaller than those of the ink jet apparatus using the conventional interdigital electrodes.

Figure 9:
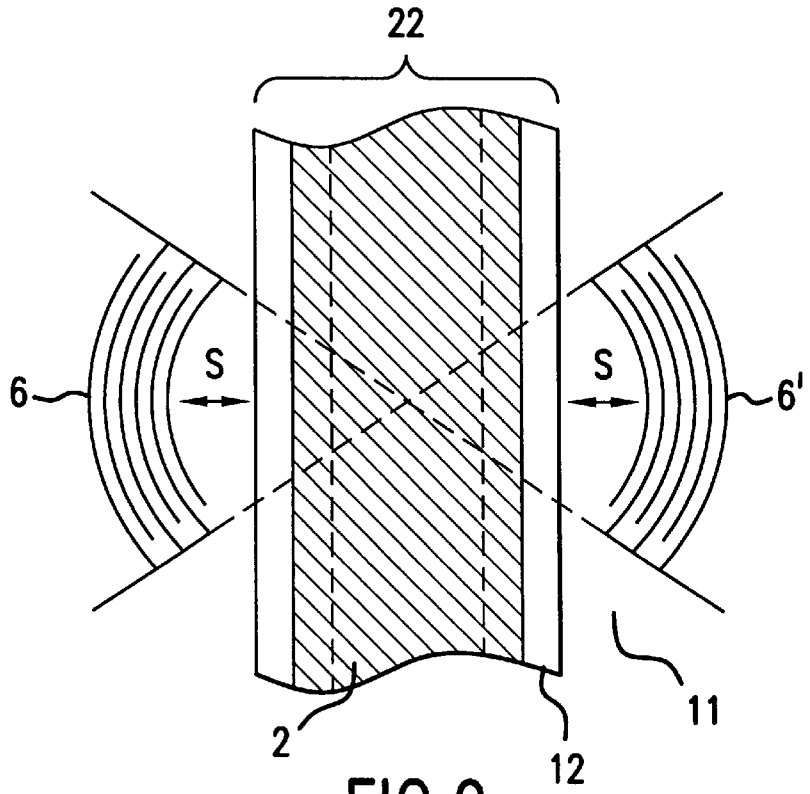
FIG. 9 is an explanatory view of the principal structure of the recording head of the fifth embodiment of the present invention.

FIG. 9 is a plan view of the principal structure of the recording head of the fifth embodiment of the present invention. The cross-sectional shape of the recording head is omitted from the drawing because it is the same with that of the first embodiment as shown in FIG. 2. Explanations for elements the same as those shown in FIGS. 1 and 6 are also neglected. The configuration of this embodiment other than a slit 22, instead of the opening 22, is the same with that of the second embodiment.

The slit 22 is formed as a groove passing through the piezoelectric substrate, and the side wall adjusts the angle θ with the perpendicular line of the ink surface by forming a slope. This slope is acoustically coupled to the surface of the piezoelectric substrate and functions as a propagating surface of the surface acoustic wave. An ink material is provided from an ink container and its surface level is adjusted to be located between the side walls of the slit. The processing of such a groove-like slit is much easier compared to those of the circular or circular-arc shape electrodes. Therefore, such a slit can be formed stably and accurately.

The interdigital electrodes are formed on the surface of the piezoelectric substrate 11 at both sides of the slit 22. The interdigital electrodes 6, 6' are formed as a circular arc shape so that the center of the concentric circle is located at the center of the slit on the ink surface.

In this embodiment, the central angle of the circular arc electrodes 6, 6' was set to be 60°. The pitch P of the interdigital electrodes were set to about 50 μm and eight pairs of interdigital electrodes were formed. A drive pulse having a basic frequency of 10 MHz, 10 V voltage was applied at the 5 KHz high frequency. The width of the silt was 200 μm and the distance s between the innermost interdigital electrode and the peripheral portion of the slit was set to 200 μm. The same ink material and the same piezoelectric substrate with the first embodiment were used for the experimentation. The Rayleigh angle of the leaked longitudinal wavelength was 20.5°. Therefore, the angle of the propagating surface of the side wall of the silt was set to be 20.5° against to the perpendicular line of the ink surface.

An ink jetting experiment was performed by using the above condition. The ink droplets were jetted to the perpendicular direction against to the ink surface accurately and stably. The diameter of the ink droplets were sufficiently smaller compared to the conventional ink-jet apparatus using parallel interdigital electrodes.

Figure 10:
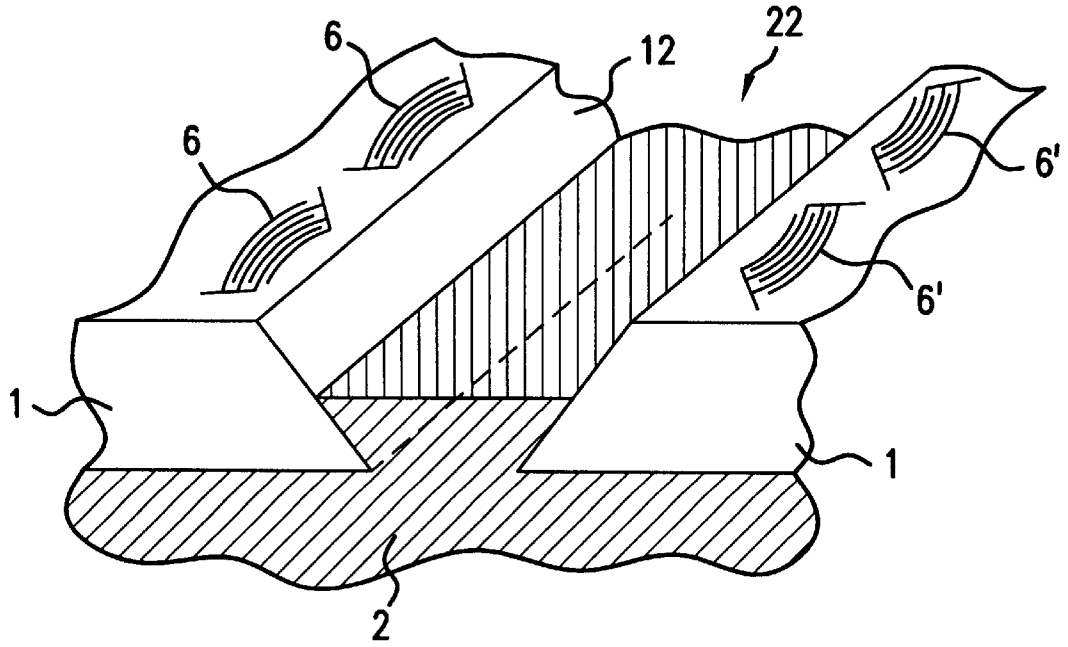
FIG. 10 is an explanatory view of the alternative design of the recording head of the fifth embodiment of the present invention.

FIG. 10 is a perspective view of the practical example of the fifth embodiment of the ink jet recording apparatus. By using a slit 22 as indicated in the fifth embodiment and plural pairs of the interdigital electrodes arranged along the slit, a recording head having plural ink discharging portions are prepared. In FIG. 10, only a portion of the pairs of the interdigital electrodes is shown. Each pair of the interdigital electrodes is arranged as shown in FIG. 9. When a recording head having plural ink discharging portions is desired, the slit configuration for the opening is preferably used rather than the circular or elliptical configuration of the opening because of the easiness of the processing thereof.

High frequency voltage is applied to each pair of the interdigital electrodes from the high frequency power source (not shown) according to the control protocol of the control circuit (not shown). Each pair of the interdigital electrodes may be driven independently, simultaneously or alternatively.

As indicated in FIG. 9 and FIG. 10, the slit 22 was formed as the groove passing through the piezoelectric substrate 1, and the ink was provided from the backside of the slit. However, another configuration of the slit also may be used, for example, the slit 22 maybe formed as a groove which does not pass through the piezoelectric substrate. In this case, ink material may be provided from the side portion of the groove 22. The side wall of the slit is also formed as the slope having the aforementioned angle configuration. The depth of the slit in this case is preferably set to a sufficient depth such that the acoustic surface wave will be leaked into the ink and decreased therein sufficient to prevent the occurrence of the unnecessary reflected pressure from the bottom of the groove.

The interdigital electrodes in this embodiment were formed as the circular-arc shape similar to those of the second embodiment, however, those electrodes may be formed as the linear electrodes as disclosed in the fourth or fifth embodiments. However, in this case, as the energy of the leaked longitudinal waves is diffused rather than concentrated at the specific portion of the ink surface, energy efficiency is relatively low. In addition, the longitudinal waves are also propagated to the adjacent opposite interdigital electrode through the slit 22, other problems such as cross-talk might be occurred.

The cross-sectional shape of the opening may be a circle as indicated in the third embodiment, an ellipse as indicated in the fourth embodiment or a slit as indicated in the fifth embodiment providing the angle of the propagating surface is controlled so that the longitudinal wave irradiated from the propagating surface of the surface acoustic wave into the ink is set to be parallel to the ink surface. Other shapes are also acceptable if the angle of the propagating surface is adjusted by the same manner as mentioned above.

Figure 11A:
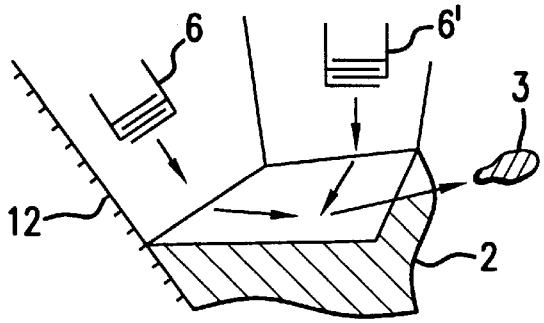
FIGS. 11(*a*), (*b*) and (*c*) are explanatory views of the recording head of the sixth embodiment of the present invention.
Figure 11B:
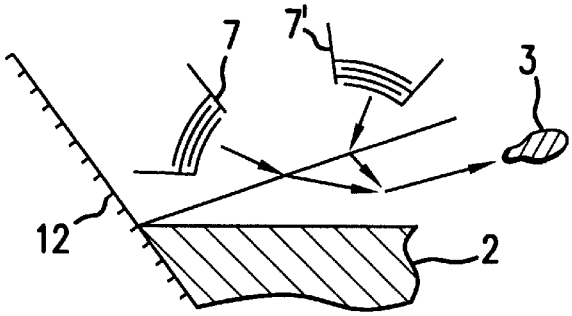
Figure 11C:
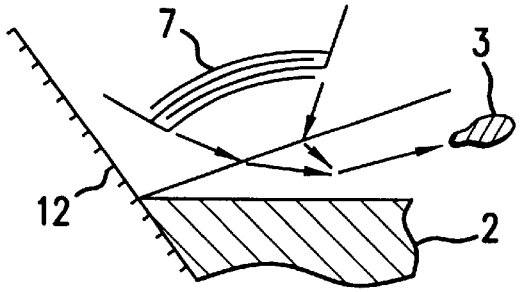

FIGS. 11(*a*)–(*c*) are explanatory views of the sixth embodiment of the recording head of the ink-jet recording apparatus of the present invention. In some former embodiments, plural surface acoustic waves are formed and opposed to each other to concentrate their energy at the specific portion in order to jet ink droplets along the perpendicular direction of the ink surface. If it is not required to jet ink droplets to a perpendicular direction of the ink surface, for example, as indicated in FIG. 5(*b*), only plural surface acoustic waves directed to one specific point without any confronting arrangement of the interdigital electrodes would be produced.

In FIG. 11(*a*), an example is disclosed in which the two linear inter digital electrodes 6, 6' are arranged with respect to each other so as to form a specific angle relationship therebetween. In FIG. 11(*b*), another example is disclosed in which the two circular arc interdigital electrodes 7, 7' are arranged so as to overlap center portions of the arc. In this event, the surface acoustic waves generated from the interdigital electrodes are leaked into the ink material and the energy of those waves is concentrated at a specific point. Then, the ink is jetted from the specific point. The direction of the ink-jetting is depends on the propagating directions of the longitudinal waves. If the propagating directions are controlled, the ink-jetting direction will be also controlled as well.

As mentioned in the second embodiment, the surface acoustic waves generated from the circular arc interdigital electrodes are concentrated at one point. By arranging only one circular arc of interdigital electrodes on the piezoelectric substrate directed toward the ink surface, ink droplets will also be produced and jetted from that point.

In all examples disclosed in FIGS. 11(*a*)–(*c*), the surface of the piezoelectric substrate and the propagating surface of the surface acoustic wave were configured as planes. This means, if once the piezoelectric substrate is immersed into the ink material so that the substrate surface and the perpendicular line of the ink surface make the angle θ, an equal ink jetting function will be obtained. By forming an opening onto the piezoelectric substrate, the same function will also be obtained.

Figure 12A:
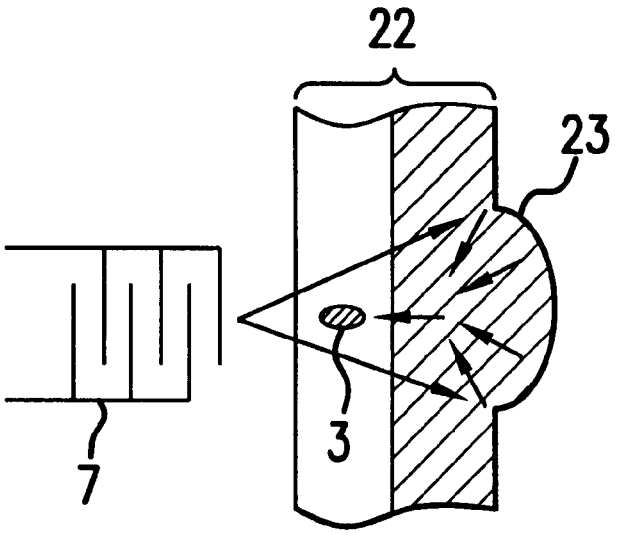
FIGS. 12(*a*) and (*b*) are both explanatory views of the alternative design of the recording head of the sixth embodiment of the present invention.
Figure 12B:
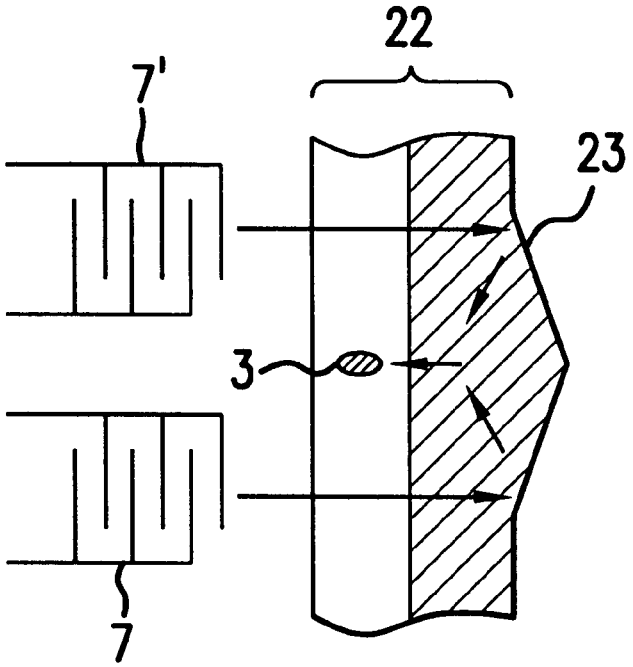
Figure 13A:
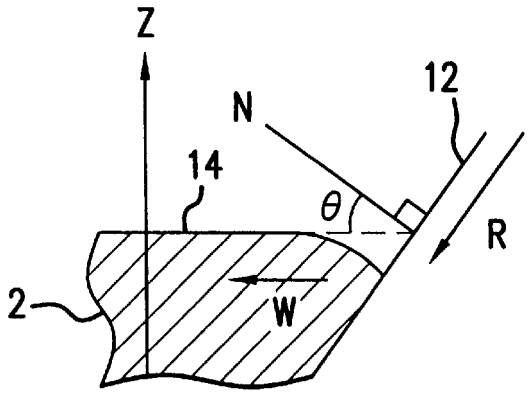
FIGS. 13(*a*), (*b*), (*c*) and (*d*) are portionally enlarged views near a contacting portion between the propagating surface and the ink surface.
Figure 13B:
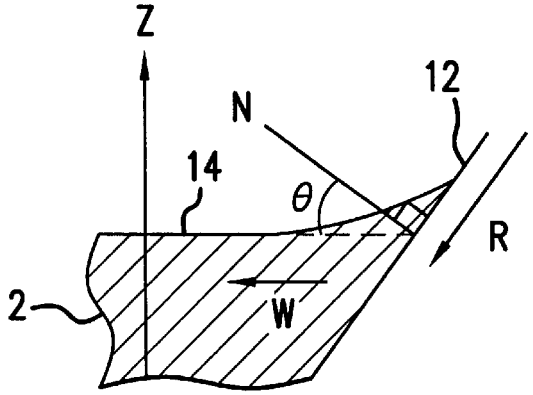
Figure 13C:
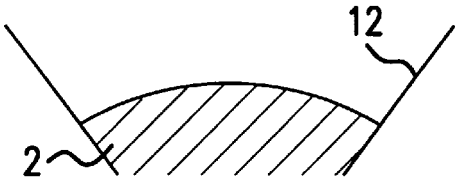
Figure 13D:
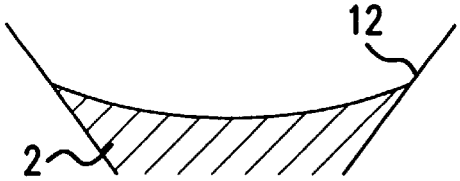

FIGS. 12(*a*)–(*b*) are explanatory views of another example of the sixth embodiment of the recording head of the ink-jet apparatus of the present invention. In this figure, 23 is a curved wall plane. Although, in former examples, the plural acoustic surface waves are concentrated by controlling the arrangement of plural interdigital electrodes, in this example, plural waves are concentrated by using a round surface of the wall plane. In the configuration as disclosed in FIG. 12(*a*), plural surface acoustic waves were generated by one interdigital electrode and were leaked into the ink material, and generated plural longitudinal waves are reflected by the round surface of the wall plane to concentrate energy of those longitudinal waves. As the leaked longitudinal waves are diffused thereafter, those diffused waves are reflected by the wall plane. By forming the wall plane to have an appropriate curvature, all waves will be concentrated at the center of the curvature.

On the other hand, in FIG. 12(*b*), the parallel surface acoustic waves generated respectively by two linear interdigital electrodes are leaked into the ink to produce leaked longitudinal waves. Those longitudinal waves are reflected by two linear wall planes which are arranged to form an appropriate angle therebetween, and finally those reflected waves are concentrated at the specific point.

In those embodiments, the propagating surface of the surface acoustic wave and the ink surface are arranged so that the surface acoustic waves will be leaked as propagating waves parallel to the ink surface.

Also, in those above embodiments, the ink surface was assumed as a flat surface, however, in several actual cases, the ink surface, especially at the contacting portion between the ink and the propagating surface, is not always considered as a flat surface due to ink property and the wetting property therebetween.

FIGS. 13(*a*)–(*d*) are enlarged partial cross-sectional views showing at least a partial non-flat ink contacting portion. When the ink is contacted to the propagating surface, sometimes, the ink surface will be formed as a convex meniscus or concave meniscus as indicated in FIGS. 13(*a*) and (*b*), respectively, because the edge portion of the ink surface is affected by the surface characteristic of the propagating surface such as contacting angle. Therefore, in this invention, the flat portion of the ink surface is defined as the free surface of the ink. The simply called "ink surface" at the above explanation means the "free surface". In the following explanation, the "ink surface" also means this "free surface" unless otherwise defined. In some excessive cases, there are no flat portions on the ink surface as indicated in FIGS. 13(*c*) and 13(*d*). In those cases, the "free surface" is defined as the plane including a tangential line at the center portion of the ink. Needless to say, the free surface is not flat in this case.

Under the circumstances as indicated in FIG. 13(*a*), (*c*), as the longitudinal wave is leaked immediately after the surface acoustic wave (R) contacts the lowered edge of the ink surface, the longitudinal wave (W) will be propagating within the ink just beneath the free surface of the ink. Under circumstances as indicated in FIG. 13(*b*), (*d*), although the longitudinal waves are also leaked immediately after the surface acoustic waves (R) contact the raised edge of the ink surface, the longitudinal waves are propagating parallel to the free surface of the ink and are reflected by the ink surface. Therefore, the surface acoustic waves (R) are propagating in the ink material until the waves reach the free surface of the ink, then the leaked longitudinal waves (W) generated at this portion are propagating parallel to the ink surface. Therefore, the first leaked longitudinal waves sometimes vibrate the ink surface, or otherwise, the reflected first leaked longitudinal waves are again reflected by the propagating surface 12. Also, there might be alternative longitudinal waves propagating along with the free surface of the ink.

Thus, even if the contacting portion between the ink and the propagating surface has an irregular shape, it is possible to generate longitudinal waves which will be propagating along with the free ink surface and to concentrate the energy of the plural longitudinal waves at a specific point in order to jet ink droplets.

In the case of FIG. 13(*a*), (*c*), as the longitudinal waves (W) are propagated in the ink material and concentrated at a specific point beneath the ink surface, in this case, additional energy will be required to jet ink droplets from the ink surface, therefore, energy efficiency might be much lower. The following seventh embodiment will be eliminate this problem.

Figure 14:
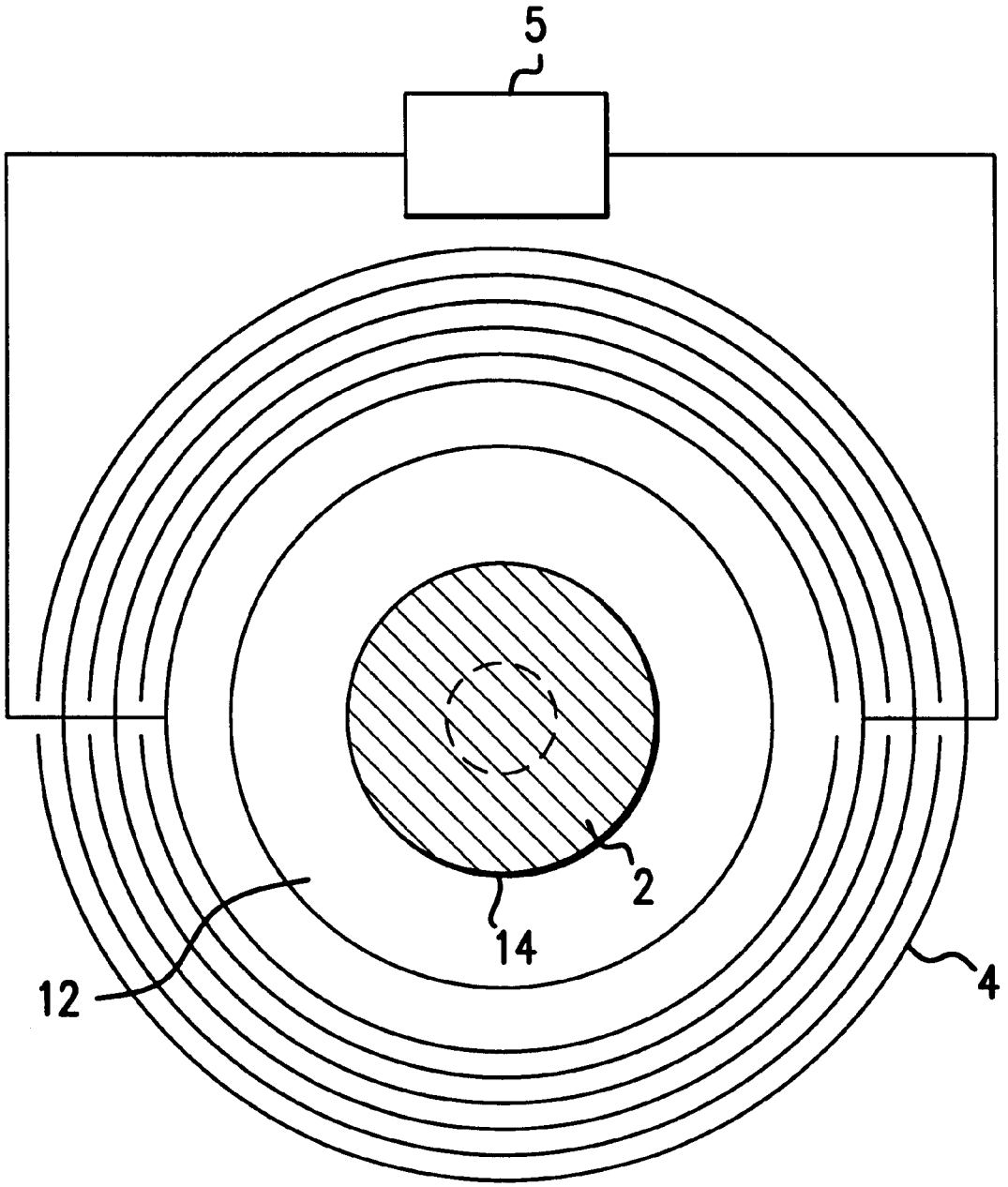
FIG. 14 is an explanatory view of the principal structure of the recording head of the seventh embodiment of the present invention.
Figure 15:
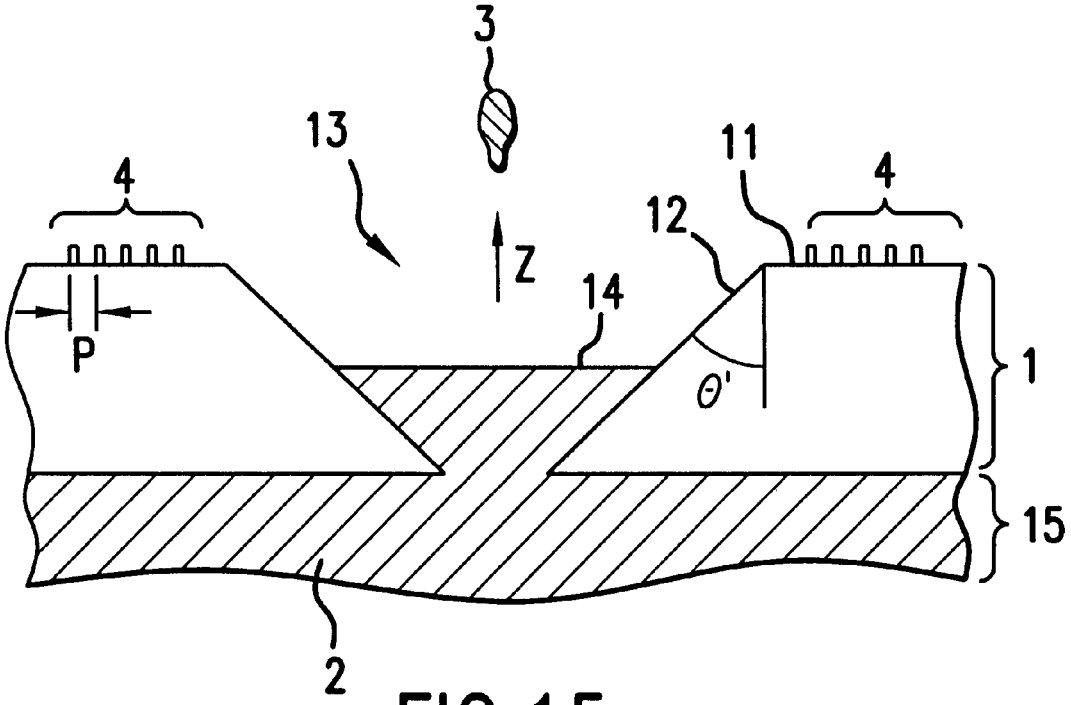
FIG. 15 is a cross-sectional view of the recording head of the seventh embodiment of the present invention.
Figure 16:
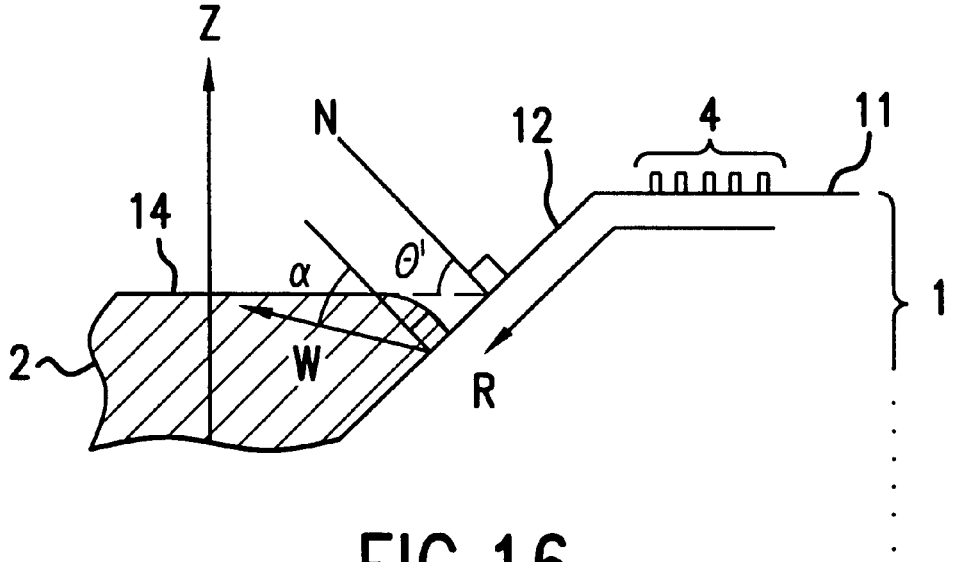
FIG. 16 is a portionally enlarged view at or near liquid surface of the opening of the recording head of the seventh embodiment of the present invention.

FIG. 14 is a plan view of the principal structure of the recording head of a seventh embodiment of the ink-jet recording apparatus of the present invention. FIG. 15 is a cross-sectional view of the recording head, and FIG. 16 is a portionally enlarged cross-sectional view of the opening near the ink surface. The same numerals of those drawings are the same meaning with those in FIGS. 1, 2 and 3. The seventh embodiment is the improved version of the first embodiment. The similar improvement might also be applicable to other embodiments.

In the seventh embodiment, the angle θ' of the propagating surface 12 of the surface acoustic wave at the opening 13, is shifted from the θ which is the angle that the propagating direction of the leaked longitudinal wave will be parallel to the ink surface. As indicated in FIG. 16, the angle θ', which is the angle between the free surface 14 of the ink and the perpendicular line (N) of the propagating surface, is set to be larger than the leaked Rayleigh angle α. Thus, the directed component from beneath the ink to the ink surface is added to the longitudinal wave in order to concentrate the energy of those waves at the surface of the ink.

For example, if the Rayleigh angle α is 20.5°, θ' may be set to 30.5°. In this case, the propagating direction (W) of the longitudinal wave is not parallel to the ink surface due to the existing of directing component of the wave directed from the beneath of the ink to the ink surface.

An actual ink jetting experiment was conducted by using this device under the same condition with the first embodiment. At the contacting portion between the ink surface and the propagating surface, small vibration of the ink surface was observed, however, ink droplets were ejected from the center portion of the opening. The vibration was due to the irradiated longitudinal waves at the contacting portion between the ink surface and the propagating surface. As almost of all longitudinal waves have a component directed to the center portion of the opening, the energy of the longitudinal waves was concentrated at the center point of the opening sufficient to jet the droplets therefrom.

The seventh embodiment is effective to such a configuration of the convex meniscus of the ink as disclosed in FIG. 16 because the focus point of the longitudinal waves, irradiated at the contacting portion between the propagating surface and the ink surface, and the level of the ink surface, at the center portion of the opening, are the same. Especially, even in the case that the hydrophobic coating is applied onto the propagating surface, the ink-jetting property will not be affected by the edge condition of the ink at the contacting portion. This configuration is also applicable to other ink meniscus configuration.

Figure 17:
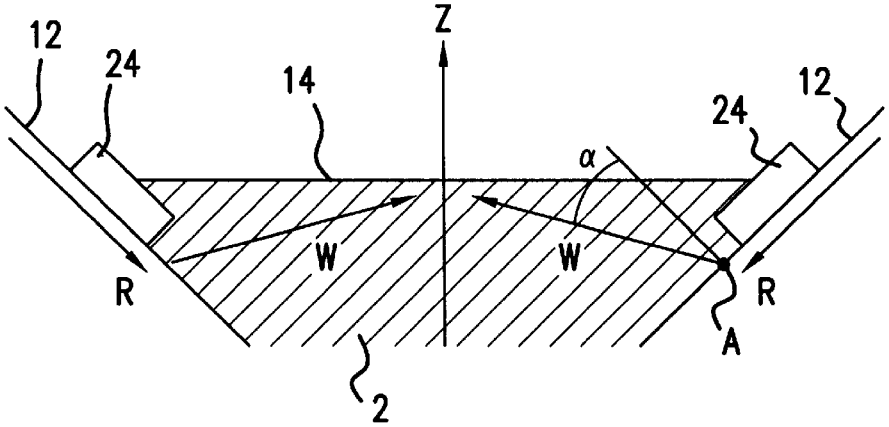
FIG. 17 is an explanatory view of the principal structure of the recording head of the eighth embodiment of the present invention.

FIG. 17 is a portional enlarged view of the principal configuration of an eighth embodiment of the recording head of the ink-jet recording apparatus of the present invention. In this figure, the same numerals are applied to the same element with those of FIG. 3, and reference number 24 is a stopping member for the propagating of the longitudinal waves. A structure of the recording head which will not be affected by the edge condition of the ink is disclosed in FIG. 13.

In the eighth embodiment, the stopping member is placed at the contacting portion between the propagating surface 12 of the opening 13 and the ink surface. The configuration other than the stopping member is the same with that of the seventh embodiment. The angle between the perpendicular line of the propagation surface and the ink surface was set to be larger than the leaked Rayleigh angle.

The stopping member prevents unnecessary reflection of the energy in the ink by preventing the direct contact between the ink and the propagating surface and prevents the attenuating of the surface acoustic waves on the propagating surface 12. The stopping member may be made from polyurethane foam, polystylene foam or other materials containing air therein. Preferably inert materials or non-permeating material to the ink are selected as the stopping member. The reason why the member prevents unnecessary vibration is that the surface acoustic wave never irradiates any longitudinal wave at the interface between the propagating surface and the air.

In FIG. 17, the surface acoustic wave propagating along with the direction R on the propagating surface contacts the stopping member rather than the surface of the ink. Although the surface acoustic waves never irradiate any longitudinal waves at this portion, the surface acoustic waves contact to the ink surface at the contacting point A and irradiate longitudinal waves into the ink at this point. In a manner similar to the seventh embodiment, the angle between the perpendicular line of the propagating surface and the ink surface is set to be larger than the leaked Rayleigh angle, and the propagating direction (W) will be directed to the center portion of the opening 13 at the surface of the ink. Therefore, in this embodiment, ink droplets will be jetted from the center portion of the opening.

The actual experiment of the ink-jetting using the device of eighth embodiment was performed with the same condition of the first embodiment. The ink droplets were jetted along with the perpendicular direction to the ink surface stably and accurately. The diameter of the ink droplets was smaller than that of the ink-jet apparatus using the conventional linear interdigital electrodes. The ink surface was stable at the contacting portion between the stopping member and the ink. The ink-jetting from the center portion of the opening at the surface of the ink surface was observed.

Thus, according to the seventh and eighth embodiment of the present invention, regardless of the shape of the edge portion around the ink material, vibration at the near contacting portion between the propagating surface and the ink surface is effectively prevented and the energy of the longitudinal waves are concentrated at the center of the opening efficiently and stably.

In the seventh and eighth embodiments, the angle between the perpendicular line of the propagating surface and the ink was set to be larger than the leaked Rayleigh angle. Although the energy efficiency will be decreased, the angle might be set smaller than the leaked Rayleigh angle to jet ink droplets. For example, in the case of concave meniscus as indicated in FIG. 13(*d*), the propagating direction directed beneath the ink surface from the ink surface might be used in terms of improved efficiency.

In the above embodiments, the propagating surface 12 is constituted by a surface having a linear cross-section. Theoretically, the propagating surface may have a linear surface having the aforementioned angle relationship in the region where at least the contacting portion interfaces with the ink material. However, a relatively long slope having a specific angle relationship with the ink on the propagating surface could compensate the changing of the altitude of the ink surface. Even if the altitude of the ink surface is changed, the specific angle relationship between the propagating surface 12 and the ink surface 14 will be maintained stably. Therefore, as mentioned before, the opening is preferably formed as a conical shape as the first embodiment or the slit having a V-shaped cross-section to form a plane surface against to the immersing direction to the ink.

As disclosed in first embodiment, if the generating surface of the surface acoustic wave and the propagating surface are constituted from surfaces different from one another, the surface acoustic wave generated by the vibrating means must be propagated to the propagating surface 12. Therefore, the surface where the vibrating means is mounted must be coupled acoustically with the propagating surface. In a manner similar to the sixth embodiment, the vibrating means may be formed on the elongated portion of the propagating surface.

Figure 18A:
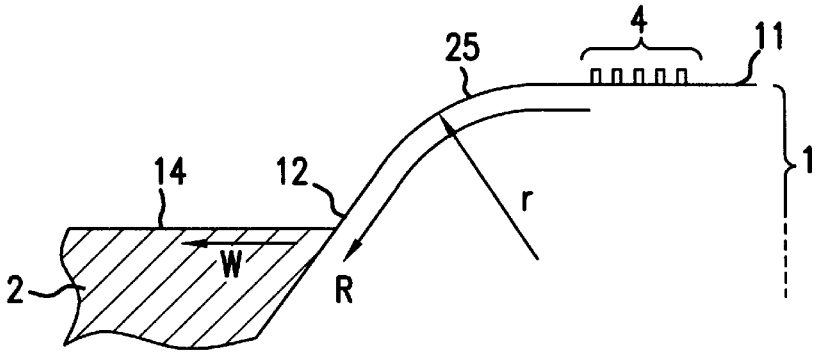
FIGS. 18(*a*) and (*b*) are both portionally enlarged views of another example of the connecting portion between the propagating surface and the generating surface of the acoustic surface wave.
Figure 18B:
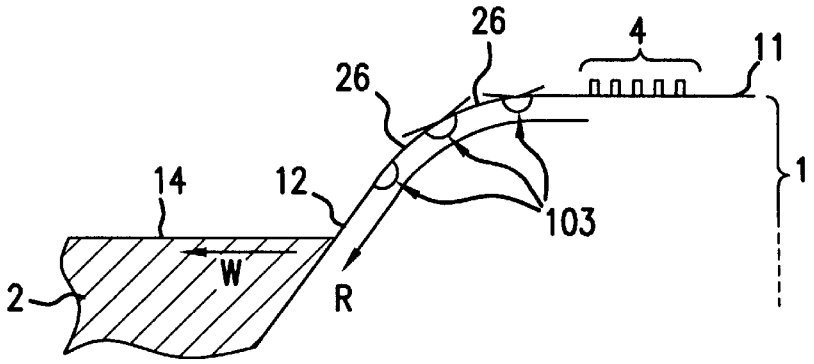
Figure 19:
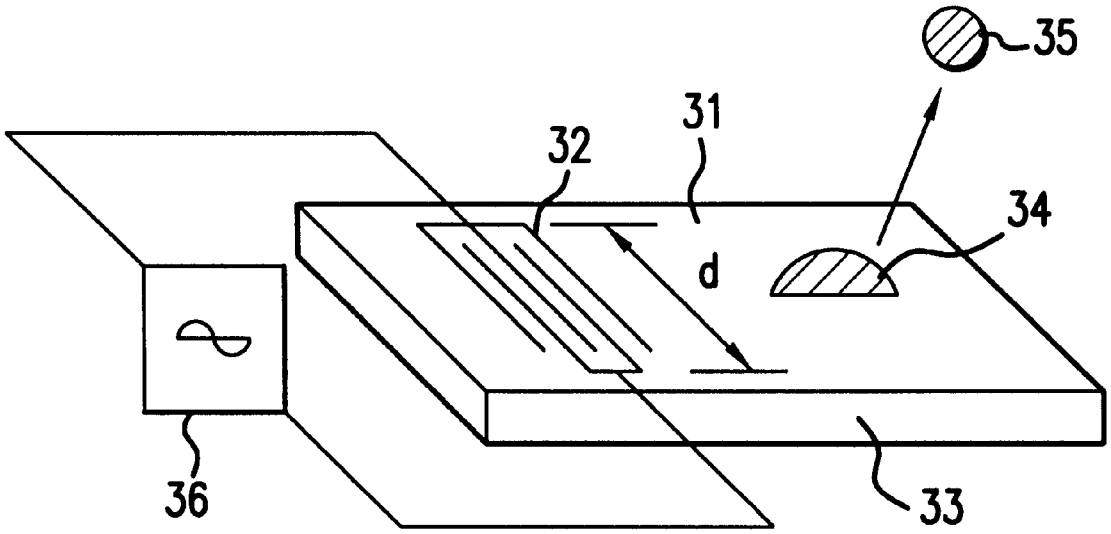
FIG.19 PRIOR ART
FIG. 19 is an explanatory view of the principal structure of the conventional ink-jet recording device using acoustic surface waves.

In embodiments 1 to 5, 7 and 8, the surface where the surface acoustic wave is generated is directly coupled to the propagating surface. In this configuration, a few reflected waves might be generated when the surface acoustic wave is propagated from its generating surface to the propagating surface 12. To prevent the generating of such reflected waves, the generating surface and the propagating surface may be coupled acoustically via other surfaces. FIGS. 18(*a*)–(*b*) show portionally enlarged views of another example of the connecting portion between the generating surface 11 and the propagating surface 12. Reference number 25 represents a curved surface and faceted portions 26 may be located on the curved surface 25. For example, as indicated in FIG. 18(*a*), the portion between the surface of the piezoelectric substrate and the propagating surface 12 may be formed by the curved surface 25. If the curvature of the curved surface 25 is set to be not less than 1.7 times, and preferably not less than 2.0 times of the wavelength $\lambda$ of the surface acoustic wave, any reflected waves will be eliminated. A discussion about the propagating characteristic of the Rayleigh short report, 1960, Soviet Union, I. A. VIKTOROV, "Passage and Reflection of Rayleigh Surface Acoustic Wave on Curved Lines with Various Radiuses," pp. 90–91.

Otherwise, as indicated in FIG. 18(*b*), the surface may be formed by the combination of the plural faceted surfaces. In this case, each faceted surface 26, adjacent to the surface of the piezoelectric substrate, adjacent to the propagating surface and located therebetween, is preferably configured so as to form an appropriate angle relationship to each other. When the inter-faceted angles 103 were set to be 150°, good results were obtained. By configuring like that, the generating of the reflected waves will be prevented. A discussion of the propagation of the Rayleigh wave on the adjacent faceted surfaces is also disclosed in Report of The Soviet Union Science Academy, Vol. 119, 3, 1958, Soviet Union, I. A. VIKTOROV, "Effect of Incomplete Surface of Transporting Medium on Propagation of Rayleigh Surface Acoustic Wave".

Each of the angles between the adjacent surfaces does not have to be the same angle if the angle is set to be not less than 150 in order to eliminate any reflected waves.

In the case that the curved portion 25 or faceted portions 26 are arranged thereon, the generating surface of the surface acoustic surface 11 and the propagating surface 12 are preferably communicated acoustically via the curved surface or the faceted surfaces.

The method for generating the surface acoustic wave by using the configuration that the interdigital electrodes are mounted on the piezoelectric surface might be the best way in terms of the accuracy, economics and reliability. Additionally, bulk waves may be irradiated to the solid surface from a direction capable to configure the leaked Rayleigh angle.

As indicated in former embodiments, all elements may be formed monolithically on the common substrate for purposes of simplicity and economy. If a photorisographic method is utilized, plural devices may be formed on a common substrate simultaneously and precisely. Otherwise, as indicated in FIG. 11(*a*), each vibrating means may be formed on respective surfaces or curved surfaces by using another processing method. In addition, if the photolithographic method is utilized for forming the vibrating elements, those elements may be build-up from each other. The vibrating elements are preferably configured by a substrate indicating a mechanical strain upon an applying of an electric field and interdigital electrodes formed thereon. By using present invention, direct contact between the interdigital electrodes and the ink material will be prevented and problems such as corrosion of the interdigital electrodes by the ink will also be prevented.

What is claimed is:

1. An ink-jet recording apparatus for jetting an ink droplet from a free surface of a supply of ink material by propagating plural surface acoustic waves to the supply of ink material, comprising:

a substrate having a planar surface;

a slant face connected and graded with respect to the planar surface, said slant face contacting the supply of ink material; and a vibration generator that generates said plural surface acoustic waves, said vibration generator being formed on the planar surface remote from the supply of the ink material and the slant face, wherein said plural surface acoustic waves are propagated in one direction along the planar surface and redirected in a second direction, different from the first direction, along the slant face to form plural longitudinal waves having propagating directions in said ink material, said propagating directions being concentrated at a certain portion within the ink material that is spaced from said slant face.

2. An ink-jet recording apparatus as set forth in claim 1, wherein said slant face is exposed to air.

3. An ink-jet recording apparatus as set forth in claim 1, wherein said slant face has a shape that causes said propagating directions of said plural longitudinal waves to be parallel to said free surface of said ink material.

4. An ink-jet recording apparatus as set forth in claim 1, wherein said slant face satisfies an equation as follows:

$$\alpha=\sin^{-1}(Vi/Vw)$$

wherein $\alpha$ is a leaked Raleigh angle defined by a perpendicular line of said slant face and said free surface of said ink material, Vi is a velocity of each of said longitudinal waves propagating within said ink material and Vw is a velocity of each of said surface acoustic waves propagating on said slant face.

5. An ink-jet recording apparatus as set forth in claim 1, wherein said slant face has a shape that causes said propagating directions of said longitudinal waves to have a propagating component directed to said free surface of said ink material.

6. An ink-jet recording apparatus as set forth in claim 1, further comprising a stopper element arranged on said slant surface where the ink material will be contacted.

7. An ink-jet recording apparatus as set forth in claim 1, wherein said substrate comprises an opening where the slant face meets the free surface of the ink material, and said vibration generator generates said plural surface acoustic waves directed toward said opening.

8. An ink-jet recording apparatus as set forth in claim 7, wherein said opening has a cross-sectional area that increases along an ink-jetting direction.

9. An ink-jet recording apparatus as set forth in claim 7, wherein said opening has one of a circular shape and an elliptic shape.

10. An ink-jet recording apparatus as set forth in claim 7, wherein said opening comprises a slit.

11. An ink-jet recording apparatus as set forth in claim 7, wherein said substrate has a surface substantially parallel to said free surface of said ink material and having said opening, said vibration generator is formed on said surface, and said plural surface acoustic waves are propagating from said surface to said slant face.

12. An ink-jet recording apparatus as set forth in claim 1, wherein said vibration generator comprises a substantially circular shape.

13. An ink-jet recording apparatus as set forth in claim 1, wherein said vibration generator comprises a substantially circular arc shape.

14. An ink-jet recording apparatus as set forth in claim 1, wherein said vibration generator comprises a plurality of vibration generating portions directed so that said longitudinal waves based on said surface acoustic waves concentrate at said certain portion.

15. An ink-jet recording apparatus as set forth in claim 14, wherein each of said vibration generating portions comprises a circular arc shape.

16. An ink-jet recording apparatus as set forth in claim 1, wherein said vibration generator is arranged on said substrate so that arrival times of said plural longitudinal waves to said certain portion will be substantially equal.

17. An inkjet recording apparatus as set forth in claim 1, wherein said substrate comprises a material indicating a mechanical strain at least on a surface of the substrate upon applying of electric field, and said vibration generator comprises plural interdigital electrodes.

18. An ink-jet recording apparatus as set forth in claim 1, wherein said slant face has a shape that causes said plural longitudinal waves to be concentrated to said certain point upon reflection from the certain point.

19. An ink-jet recording method for jetting an ink droplet from a free surface of an ink material by propagating plural surface acoustic waves along a substrate having a planar surface and a graded slant face to the supply of the ink material, said method comprising the steps of:

generating said plural surface acoustic waves along the planar surface;

redirecting the plural surface acoustic waves along the graded slant face of the substrate that contacts the ink material;

inputting said plural surface acoustic waves to the free surface of said ink material at an angle defined between the planar surface and the slant face to generate plural longitudinal waves in the ink material; and concentrating said plural longitudinal waves at a certain point within said ink material in order to jet an ink droplet from the certain point in the ink material that is spaced from the slant face.

20. An ink-jet recording method as set forth in claim 19, wherein said plural surface acoustic waves are generated by a vibration generator arranged in one of a circular shape and an elliptical shape.

21. An ink-jet recording method as set forth in claim 19, wherein said plural surface acoustic waves are inputted into said free surface of said ink material so that propagating directions of said longitudinal waves will be substantially parallel to said free surface.

22. An ink-jet recording apparatus for jetting an ink droplet from a free surface of a supply of ink material by propagating plural surface acoustic waves to the supply of ink material, comprising:

a substrate having a planar surface;

at least one pair of slant faces formed on the substrate substantially facing each other, each of said slant faces being graded with respect to the planar surface and contacting the supply of ink material; and a vibration generator that generates said plural surface acoustic waves, said vibration generator being formed on the planar surface remote from the ink supply of the ink material and the slant faces, wherein said plural surface acoustic waves are propagated along the planar surface and redirected along the slant faces to form plural longitudinal waves having propagating directions in said ink material, said propagating directions being concentrated at a certain portion within the ink material that is spaced from the slant faces.

23. An ink-jet recording apparatus as set forth in claim 22, wherein said vibration generator is coupled acoustically with said slant faces through a curved portion of said substrate.

24. An ink-jet recording apparatus as set forth in claim 23, wherein said curved portion has a curvature having a magnitude not less than twice of a wavelength of said plural surface acoustic waves.

* * * * *